US005127479A

United States Patent [19]

Stehling et al.

[11] Patent Number: 5,127,479

[45] Date of Patent: Jul. 7, 1992

[54] FIRE EXTINGUISHING SYSTEM FOR COOKSTOVES AND RANGES

[75] Inventors: Henry J. Stehling, Irving; Grady North, Grapevine; Paul Rouse; David Dunston, both of Irving, all of Tex.

[73] Assignee: 21st Century International Fire Equipment Services Corporation, Irving, Tex.

[21] Appl. No.: 634,357

[22] Filed: Dec. 31, 1990

[51] Int. Cl.[5] ..... A62C 3/00; A62C 37/12; A62C 35/68

[52] U.S. Cl. ..... 169/65; 169/16; 169/59; 285/31

[58] Field of Search ..... 169/65, 16, 59, 9; 285/31, 30, 170, 175, 169

[56] References Cited

U.S. PATENT DOCUMENTS

| | | | |
|---|---|---|---|
| 1,186,249 | 6/1916 | Walker | 169/59 |
| 1,246,657 | 11/1917 | Pyzel | 169/59 |
| 1,562,949 | 11/1925 | Erwin | 169/59 |
| 1,612,622 | 12/1926 | Erwin | 169/59 |
| 3,463,233 | 8/1969 | Haessler | 169/9 X |
| 4,256,181 | 3/1981 | Searcy | 169/65 |
| 4,773,485 | 9/1988 | Silverman | 169/65 |
| 4,834,188 | 5/1989 | Silverman | 169/65 |

FOREIGN PATENT DOCUMENTS

| | | | |
|---|---|---|---|
| 89299 | 8/1978 | Japan | 169/16 |

*Primary Examiner*—Margaret A. Focarino
*Assistant Examiner*—James M. Kannofsky

[57] ABSTRACT

A fire extinguishing system for a residential cookstove or range includes a fire extinguisher mounted above a hood in a cabinet positioned over the cookstove or range. The fire extinguisher is connected by flexible hoses and/or adjustable pipes to a pair of nozzles within the hood to dispense fire suppressant over the cookstove or range. The fire extinguisher includes an operator normally biased to the operable position, but held in the inoperable position by a cable system having a plurality of fusible or reusable, heat-activated links distributed therein. The cable system is held in tension adjacent the inner periphery of the hood and includes a section of chain to facilitate installation. Upon the occurrence of a fire, at least one of the links separates, releasing the cable system and allowing the operator to move to the operating position whereby the fire extinguisher releases the fire suppressant.

8 Claims, 5 Drawing Sheets

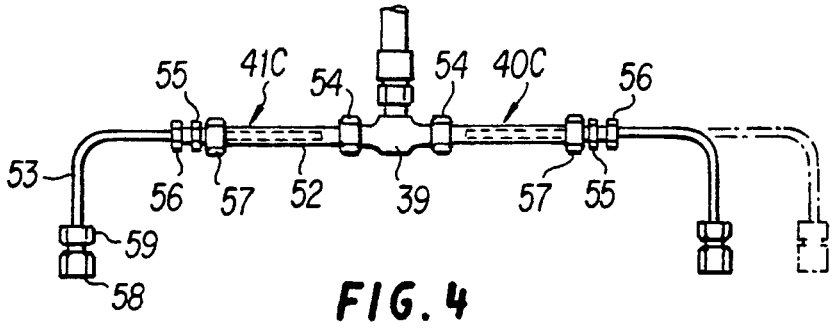
FIG. 4
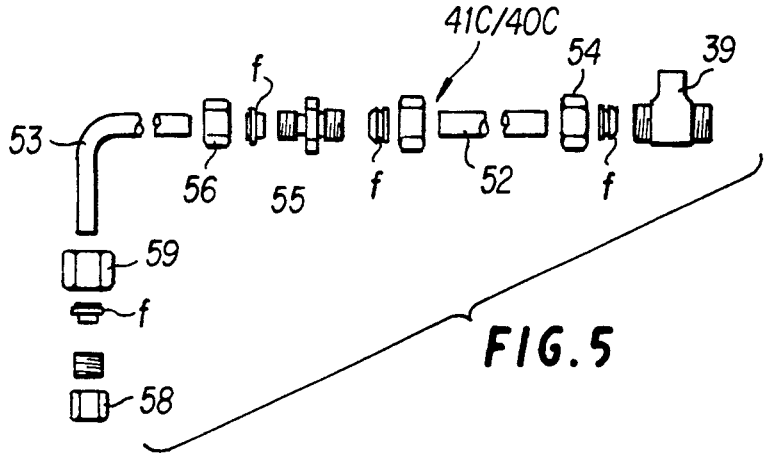
FIG. 5
FIG. 3A
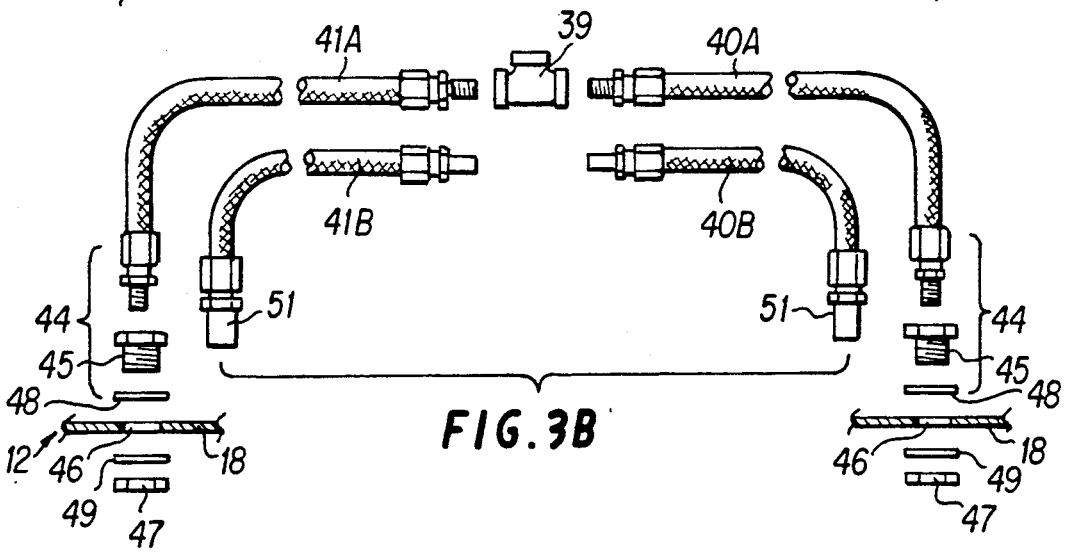
FIG. 3B

FIRE EXTINGUISHING SYSTEM FOR COOKSTOVES AND RANGES

BACKGROUND OF THE INVENTION

This invention relates to an automatically operated fire extinguishing system usable for both electrical and gas residential cookstoves or ranges. More particularly, the invention concerns such a system which is mounted in a hood positioned over a residential stove or range.

Until relatively recently, automatic fire extinguishing systems for use with cookstoves and ranges have generally been concerned with extinguishing fires caused by fat burning in a commercial grease pot or kettle. Generally, the systems were solely concerned with extinguishing the fire. No provision was made for turning off electrical and gas burners of the stove. Consequently, the fire extinguishing system would extinguish the lighted burners of a gas stove while allowing the gas to continue flowing. This created the very hazardous condition of allowing unburned gas to flow from the burners, resulting in a situation in which a residence could fill with gas to dangerous levels and then explode. Or perhaps, on the other hand, the residents were exposed to the hazard of being asphyxiated by gas fumes. If the system is used with an electric stove, the burners could reignite spilled grease and fat once the fire extinguishing foam had dissipated. Moreover, these arrangements had no provision for sounding an alarm or deenergizing associated exhaust equipment.

U.S. Pat. No. 3,653,443 recognized the aforementioned difficulties with the prior art and provided a system for shutting off the stove, operating an alarm and deenergize exhaust fans. To the knowledge of the instant inventor, the concepts set forth in U.S. Pat. No. 3,653,443 have never been commercialized. The particular arrangement set forth in this patent has apparently not been commercialized because of the expense and difficulty in combining the concept of this patent with existing residential hood configurations. In other words, the particular structure disclosed in this patent is not readily retrofittable on existing residential stoves and stove hoods.

The prior art discloses numerous arrangements for automatically extinguishing stove fires. U.S. Pat. No. 4,256,181 discloses a fire extinguisher in combination with a hood. However, this patent requires a tube for conducting heat from the stove to a mechanism for operating the fire extinguisher. The operating mechanism includes a flammable fuel which generates heat in a hood above the stove making the operating system itself a fire hazard. The foam from the extinguisher is dispensed on the stove.

Other patents, such as U.S. Pat. Nos. 4,580,638; 3,584,688; 3,448,808; and 3,824,374, each disclose arrangements of cables and fusible links. However, these arrangements are not configured in a fashion which is readily adaptable to retrofitting in existing residential stove hoods or existing residential stove configurations. These arrangements are suitable for commercial kitchens rather than residential kitchens.

In order for an automatic fire extinguishing system to be widely used in home kitchens, it is necessary for the system to be configured so that any home owner or resident with minimal mechanical skills can install the system. Ordinarily, household fire warning equipment designed to be installed by other than a qualified electrician cannot be powered from a source having a voltage in excess of 30 volts. Accordingly, in order to avoid the need for a qualified electrician, stove fire extinguishing systems must operate on less than 30 volts. None of the systems currently available meet this requirement, since they all require house line current.

If a range utilizes gas as a fuel and electric power to the house is interrupted, the systems currently available will not function properly during a power outage, since there is no power available to control the flow of gas to the gas burners. Accordingly, a very dangerous situation arises if there is a power outage during which a stove fire is extinguished, but gas continues to flow through the burners. The gas in and of itself can asphyxiate people in the house or can accumulate and explode when the electricity comes back on and generates a miscellaneous spark at a location in the house where gas has accumulated. The systems of the prior art do not protect residences in this particular situation.

In view of the aforementioned deficiencies in previously existing fire-suppressing systems when applied to residential cookstoves, the assignee of the instant invention developed the fire-suppressing systems disclosed in U.S. Pat. Nos. 4,773,485 and 4,834,188. While the systems disclosed in these patents have achieved acceptance in the field and have been installed in combination with hundreds of cookstoves, their installation requires a level of skill which may be beyond that of many householders. Accordingly, there is a need to configure the systems, as basically disclosed in these two patents, in such a way that more householders can readily install the systems. Moreover, configuring the system for relatively easy installation allows skilled installers to proceed more rapidly and less expensively.

SUMMARY OF THE INVENTION

It is an object of the instant invention to provide a new and improved system for extinguishing fires on residential cookstoves and ranges wherein the system is automatic and is readily retrofittable to existing residential stove hoods.

Upon further study of the specification and appended claims, further objects and advantages of this invention will become apparent to those skilled in the art.

In view of the aforementioned object, and other objects, the instant invention contemplates a fire extinguishing system for a residential cookstove or range wherein the fire extinguishing system is mounted within a kitchen cabinet and extends into a hood which is positioned over the residential stove or range. The system comprises a fire extinguisher having an operator biased to a first position, in which the fire extinguisher releases a fire extinguishing substance, and retained in a second position, in which the fire extinguisher retains the fire extinguishing substance. A cable is attached to the operator of the fire extinguisher for holding the operator in the second position. The cable extends into the hood and extends adjacent the sides of the hood. At one location, such as the front of the hood, the cable is connected to one end of a chain; and the chain, in turn, is connected at its other end to another cable. The chain allows rapid, easy adjustment, facilitating installation by a householder. A plurality of fusible links or temperature-sensitive, reusable links are disposed within the cable-chain system and distributed around the hood wherein, when there is a fire on the stove or range, at least one of the links will separate, releasing the cable to allow the fire extinguisher operator to move from the second position to the first position and thereby release the fire extinguishing substance onto the stove top.

In order to facilitate ease of installation, in one embodiment, the nozzles are connected to a tee with non-rigid piping so that the piping can be easily routed around obstacles within the cabinet. In an alternative arrangement, the nozzles are connected to the tee with adjustable piping, wherein the length of the piping is adjusted by telescoping one pipe with another. In either case, the single port of the tee is connected by a flexible hose to the fire extinguisher.

Connected to the fire extinguisher is a detector which detects when the fire extinguisher begins to operate. Connected to the detector is a shut-off mechanism which shuts off electrical power or gas to the stove and, if desired, deenergizes a fan in the hood. In addition, an alarm in the house and/or at a remote location such as a fire station may be sounded. The various electrical elements may be powered from a low-voltage source so that the system may be installed by a householder with minimal expense.

BRIEF DESCRIPTION OF THE DRAWINGS

FIG. 3A and 3B are side views of a pair of flexible hoses supplied as an installation kit with the fire extinguishing system of the instant invention;

FIG. 4 is a side view of an adjustable length, steel piping kit used with the fire extinguishing system of the instant invention.

FIG. 5 is an exploded view of one of the adjustable length pipes of FIG. 4;

DETAILED DESCRIPTION

Figure 1:
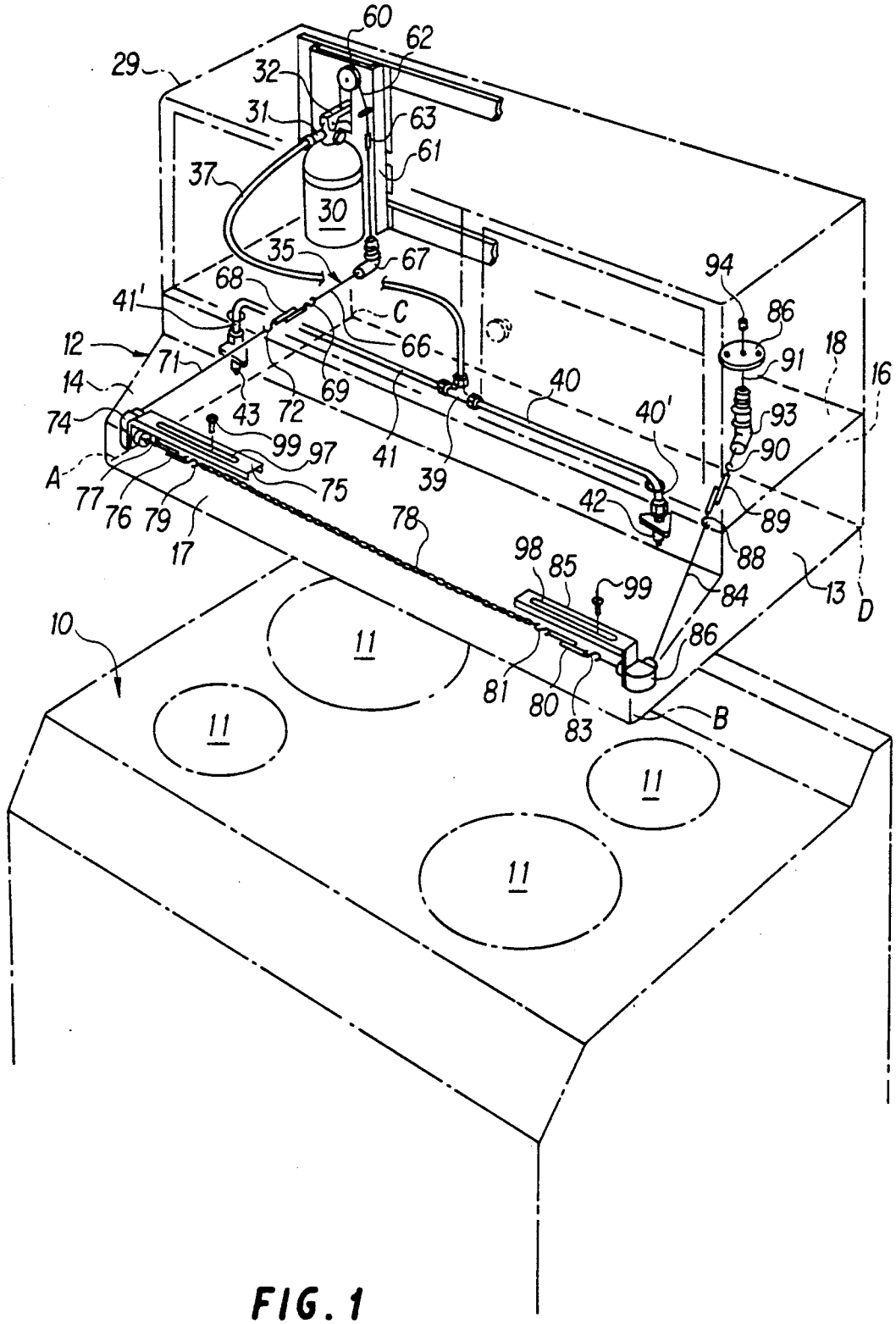
FIG. 1 is a perspective view of a fire extinguishing system in combination with a residential stove, hood, and adjacent cabinet, configured in accordance with the principles of the instant invention.

Referring now to FIG. 1 there is shown a residential stove or range, designated generally by the numeral 10, which includes a plurality of burners 11. Positioned over the stove or range 10 is a conventional hood, designated generally by the numeral 12. The hood 12 has a pair of sidewalls 13 and 14, a rear wall 16, a front wall 17 and a top wall 18 and has corresponding first and second front corners A and B and first and second rear corners C and D. The hood 12 has an opening (not shown), preferably through the top surface 18 thereof which is attached to a duct (not shown) having an exhaust fan (not shown) therein for forcibly evacuating fumes and vapor which collect in the hood while cooking on the residential stove 10 (see U.S. Pat. No. 4,834,188, incorporated herein by reference).

In accordance with the principles of the instant invention, a fire extinguisher, designated generally by the numeral 30, is positioned adjacent to, and preferably over the hood 12 in a cabinet 29, schematically illustrated by a broken line. The fire extinguisher 30 is a conventional extinguisher and may dispense either a liquid or dry fire suppressant material. In accordance with the preferred embodiment of the invention, the extinguishing agent is a dry chemical agent. For residential use, the chemical agent is 4.5 pounds by weight and made according to a formulation that is designed for rapid flame knockdown and securement of cooking grease-related fires. The agent discharge time is at least 15–30 seconds to insure fire extinguishment and eliminate flashback. The discharge rate is gentle enough to avoid splattering of burning grease.

Figure 2:
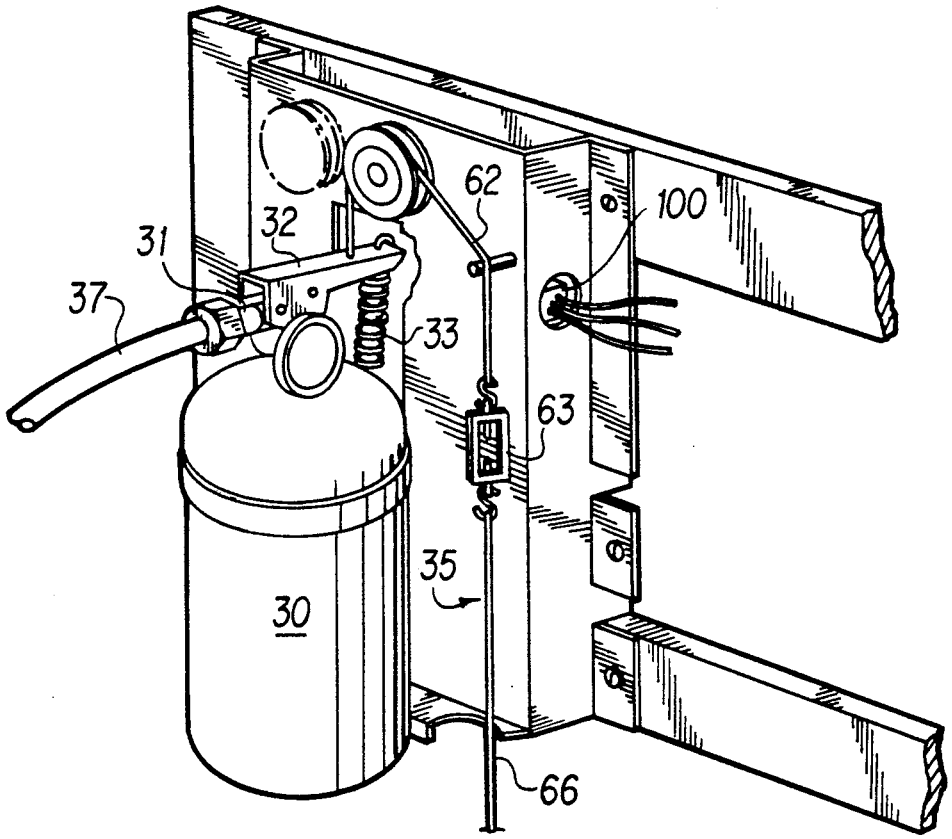
FIG. 2 is a perspective view of a mounting bracket for a fire extinguisher used in the combination of FIG. 1.

As is best seen in FIG. 2, the fire extinguisher 30 has an outlet 31 through which the fire suppressant material flows under pressure upon moving operating lever 32 downwardly. The operating lever 32 is attached to a coil spring 33 which is under tension. The coil spring 33 biases the operating lever 32 downwardly so as to eject fire suppressant material through the outlet 31. As will be explained more fully hereinafter, the operating lever 32 is held in a first, non-operating position by tension on a cable assembly, designated generally by numeral 35. Upon release of the tension on the cable assembly 35, the operating lever 32 moves to a second position as the spring 33 contracts and the material moves out through the nozzle 31, through a flexible hose 37 to a T-joint 39 (FIG. 1).

In accordance with the principles of the instant invention and as is seen in FIG. 1, the flexible hose 37 allows the installer to maneuver around obstacles in the cabinet 29. The T-joint 39 is connected to a pair of horizontal pipes 40 and 41 extending in the cabinet 29 in directions toward the sidewalls of the cabinet. The end sections 40' and 41' of each of the pipes 40 and 41 are bent at approximately 90° with respect to the horizontal sections 40' and 41' of the pipes. The end sections through which the fire suppressant nozzles are attached expands and covers the top of the stove or range 10, putting out any fire thereon.

In accordance with the improvements of the instant invention, the fire extinguishing system is distributed as a kit with a selection of piping systems for the pipes 40 and 41. As is seen in FIGS. 3A and 3B, the pipes 40 and 41 are configured as flexible hose pairs 40A–41A and 40B–41B. The flexible hose pairs have lengths in the range of 10–30" in overall length and are factory preassembled. The flexible hoses 40A–41A and 40B–41B allow the installer to route the hoses around obstacles in the cabinet 29, greatly facilitating installation by skilled installers, while making the system easier to install by inexperienced installers or householders. With the non-rigid hose assemblies 40A–41A and 40B–41B, it is necessary that the hose lengths 40 and 41 be equal so that the T-joint 39 is centered between the nozzles 43.

When access to both sides of the top surface 18 of the range hood 12 is available, it is suggested that the arrangement of FIG. 3A be used wherein quick seal adaptors, designated generally by the numerals 44, are provided. Each quick seal adaptor 44 includes an internally and externally threaded sleeve 45 retained in a hole 46 through top wall 18 of the hood 12 by a nut 47. A pair of washers 48 and 49 are positioned on the sleeve 45 on opposite sides of the top wall 18 of the hood 12. The hoses 40A and 41A each have a threaded end fitting 50, which screws into and projects beyond the sleeve 45 a sufficient distance to allow attachment of the nozzles 42 and 43, respectively.

The hose pair 40B and 41B of FIG. 3B relies on ¼", schedule 40 black iron, pipe nozzles and/or couplings 51. In any case, the maximum overall length of the flexible hoses, including nipples or couplings must not exceed 30".

Referring now to FIGS. 4 and 5, there is shown another piping kit arrangement wherein the pipes 40C and 41C are each configured of a straight stainless steel section 52 and an L-shaped stainless steel section 53 telescopically received in the straight section. The straight section 52 is coupled to the T-joint 39 by a nut 54 and compression ferrules squeezed thereagainst, while the L-shaped section 5 is coupled to the straight section, with a union 55 attached via nuts 56 and 57 threaded thereon. Again, compression ferrules f are squeezed against the pipe sections 52 and 53 by the nuts 56 and 57 to fix the pipe section with respect to one another. The pipe sections 40C and 41C of FIGS. 4 and 5 have a minimum length from the center of the tee 39 of 8" and telescope to a maximum length of 13". It is preferable that the downward leg of the L-shaped section have a length in the range of 3-5", with a preferable length of about 3". In a commercial embodiment, the straight section 52 has an inner diameter of a little less than ½", and the L-shaped section 53 has an outer diameter of ⅜" so that the sections readily telescope. At the free ends of the L-shaped sections 53, either a male or female fitting 58 is secured by compression nuts 59 and internal ferrules f for attaching the nozzles 42 and 43. Again, it is preferably that the pipes 40C and 41C be of equal length when installed.

Referring again to FIGS. 1 and 2, the cable assembly 35, which holds the operating handle 32 in the first position against the bias of spring 33, is looped over a first pulley 60 journalled on a mounting bracket 61 which supports the fire extinguisher 30. The bracket 61 is rigidly attached to a side or rear wall of the cabinet 29. As is seen in FIG. 2, the cable 35 has a first section 62 which is attached to a turnbuckle 63 that allows adjustment of the cable. A second section of the cable 66 is attached to the other end of the turnbuckle and is trained around a pulley 67 that is secured to the underside of the top wall 18 of the hood 12 which has a hole therethrough through which the second section of the cable passes. The second section of the cable 66 exits from the pulley 67 at a right angle to the direction in which it entered the pulley and extends a distance horizontally within the hood 12 generally parallel to the side 14 of the hood. A first fusible or reusable link 68 is attached to the second length of cable 66 by an S-hook 69. The other end of the fusible link 68 is attached to a third length of cable 71 by a second S-hook 72. The third length of cable 71 is trained around a second pulley 74 mounted on an L-shaped bracket 75 in the first front corner A of the hood 12 and emerges adjacent the front wall 17 of the hood where it is connected to a second fusible link 76 by an S-hook 77.

In accordance with the principles of the instant invention, the second fusible or reusable link 76 is connected to a length of chain 78 by an S-hook 79 which extends behind the front wall 17 a distance to a fourth heat fusible link 80 to which the length of chain is connected by an S-hook 81. The length of the chain 78 is readily determined by selecting the links within the chain which are engaged by S-hooks 79 and 81. Once the entire cable assembly 35 is strung through the pulleys, the assembly is rendered substantially taut by hooking of the end of the chain 78 in one of the S-hooks 79 or 81; pulling the chain and other S-hook toward one another and, when the chain is taut, hooking with the free S-hook the chain link closest to the free S-hook. A fourth length of cable 84 is attached by an S-hook 83 to the fusible or reusable link 80 and extends around a third pulley 86 mounted at corner B on L-shaped bracket 85 so as to extend along behind the sidewall 13 of the hood 12. The fourth cable 84 is connected by S-hook 88 to a fourth fusible or reusable length 89 and by S-hook 90 to a fifth length of cable 91. The fifth length of cable 91 is trained around a fourth pulley 93 and emerges through the top wall 18 of the hood 12 where it is secured to a stop 94. The stop 94 prevents the fifth cable 71 from sliding through a hole 95 in a flange 86 which is positioned on the bottom of the cabinet 29. The cable assembly 35 and fusible links are not enclosed in conduits or housings but are exposed. However, the cable and links are ordinarily concealed from view because they are within the hood structure.

The L-shaped brackets 75 and 85 have slots 97 and 9B therein, which receive screws 99 to adjustably secure the brackets to the wall of the hood 12. In the illustrated embodiment, the brackets 75 and 85 are attached by screws or bolts 99 to the inner surface of the top wall of the hood 12; however, since the pulley housings 74 and 86 are rotatable with respect to the brackets, the brackets can also be mounted on the inner surface of front wall 17 of the hood.

The fire extinguishing system in accordance with the principles of the instant invention may be installed by the average homeowner using existing tools. First, the fire extinguisher 30 is placed above the hood 12 in the cabinet 29. The flexible pipe 37 for carrying fire suppressant from the fire extinguisher 30 is then connected in the cabinet to the T-joint 39, and the horizontally extending pipes 40 and 41 selected from FIGS. 3 and 5 are screwed into the tee joint. Holes are made through the bottom of the cabinet 29 and the top wall 18 of the hood 12 and the downwardly extending ends of the pipes 40 and 41 extended therethrough. After the pipes 41 and 41 are secured within the holes through the bottom of the cabinet 29 and top of the hood 12, nozzles 42 and 43 are screwed into the ends of the pipes.

After the piping is installed, the cable assembly 35 with the chain 78 is strung through the system by sequentially attaching the fusible or reusable links 68, 76, 80, and 89 thereto with the various S-hooks. The portion of the fourth cable section 91 which extends through plate 95 is then secured by fixing the stop 94 to the end of the fourth cable section 91. The turnbuckle 63 can then be shortened to take up any slack in the cable assembly 35 and to tension the cable assembly. Spring 33 is then anchored behind the bracket 39 at one end and stretched to reach and overlie the handle 32 so as to bias the handle 32 in a downward direction toward the second position. Tension in the cable assembly 35 retains the handle 32 in the first position. The fire extinguishing system is now set to automatically operate upon the occurrence of a fire on the stove 10.

When there is a fire on the stove, the fire will melt the solder or other material fusing the halves of at least one of the links 48, 56, 60 and 69 together. As soon as one of the links separates due to heat from the fire, the cable 35 will no longer be tensioned and spring 33 will move the handle 32 from its first position to its second position, causing the extinguisher 30 to release the fire suppressant chemicals therein. The extinguisher 30 will continue to operate until the fire suppressant chemical is exhausted.

If there is no one present when the fire occurs, to turn off the burners 11 on the stove 10, the dangerous condition which caused the fire in the first place can resume without there being any further provision for putting out a subsequent fire. Since discharging the fire extinguisher 30 does not automatically turn off the source of heat which started the fire initially, the burners 11, if they are electrical burners, will continue to generate heat. After a while, the grease which remains on the stove 10 may again reignite. Since the fire extinguishing system is a one-shot arrangement, the subsequent fire cannot be extinguished by the system. If the burners 11 are gas burners, the fire suppressant will extinguish the burners; however, the gas for energizing the burners will continue to enter the stove and pour into the room without burning. This accumulation of gas could result in a subsequent explosion or could asphyxiate people in the residence where the stove 10 is located.

In order to prevent the occurrence of these situations, a microswitch 100 detects when the handle of the extinguisher is moved down by spring 33, causing the fire extinguisher 30 to discharge. Microswitch 100 is connected by leads to the circuit of FIG. 6. As will be explained more specifically hereinafter, the microswitch 100 operates either a gas valve 101 or electrical switch 102 via a 12-volt solenoid 103 to shut off the supply of electricity or gas when the microswitch detects a discharge by the fire extinguisher 30.

Figure 6:
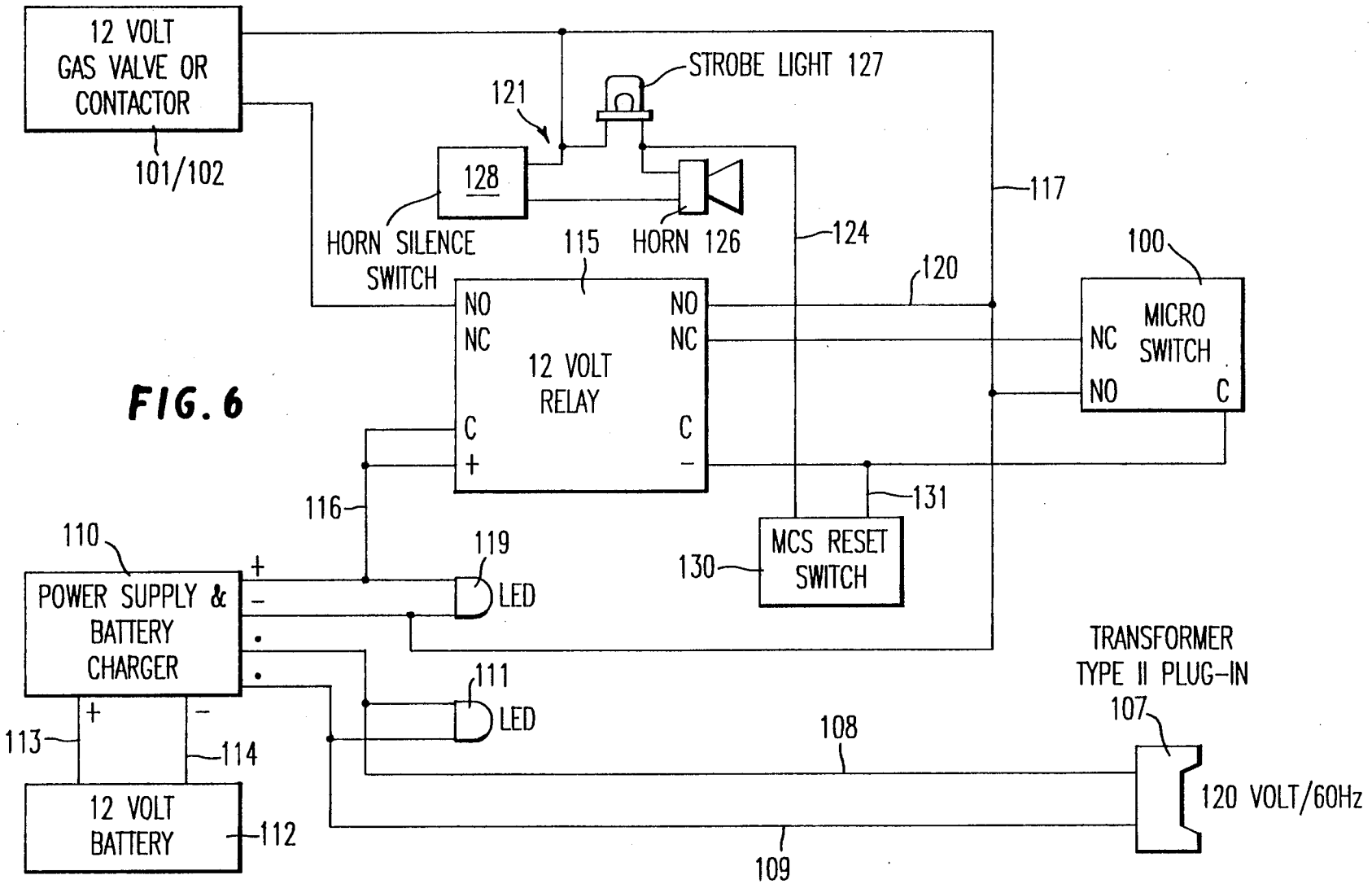
FIG. 6 is a circuit diagram of a control circuit usable with the fire extinguishing system of the instant invention.

The circuit of FIG. 6 is connected to 120-volt/60-hz house current through a plug-in-type transformer 107 which is connected by leads 108 and 109 to a power supply/battery charger 110. An indicator LED 111 indicates that power is flowing through to the power supply and battery charger 110. A 12-volt battery 112 is connected by leads 113 and 114 to the power supply/-battery charger and provides 12-volt power to the system in situations wherein the available house current has been interrupted for one reason or another.

The power supply/battery charger 110 has its positive pin connected to a 12-volt relay 115 via line 116 which is connected to both the positive pin on the relay and to one of the closed contacts on the relay. The line 117 from the negative pin of the power supply/battery charger 110 is connected to various other components of the system, while a second LED 119 indicates that the power supply is providing its output. Line 117 is connected to a normally open contact on the microswitch 100 and to the negative pole of the solenoid associated with the valve 101 or the contactor 102, as well as the normally open contact of the 12-volt relay 115 via line 120 and the alarm circuit elements, designated generally by the numeral !21. The solenoid associated with the valve 101 or the contactor has its positive pole connected to a normally open contact on the 12-volt relay 115, while the microswitch has its closed contact connected to the negative pole of the 12-volt relay and its normally closed contact connected to the normally closed contact on the 12-volt relay. Upon an increase in pressure in line 31, the microswitch 100 opens its normally closed contact and closes its normally open contact which causes the 12-volt relay 115 to open its normally closed contact on the negative side and to close its normally open contact on the negative side, while closing its normally open contact on the positive side. This causes 12-volt direct current to flow through lines 117 and 122 so as to activate the solenoid 101 and either close the associated gas valve 101 or open the associated electrical switch 102, thus interrupting gas or electricity which might reignite the fire subsequent to the fire being initially extinguished by discharge of the fire extinguisher 30.

Upon operation of the microswitch 100, the microswitch also energizes horn 126 and optional strobe light 127 in the alarm circuit 121 by closing the normally open contact in 12-volt relay 115 so that current flows through line 117 and through line 124 to energize the horn 126 and power the strobe light 127. The horn 126, of course, alerts the household that there is a fire while warning people to leave the house while at the same time identifying the particular source of the fire. The horn silence switch allows one to shut the horn off after the conflagration has ceased.

Reset switch 130 is connected via line 124 to the closed contact of the 12-volt relay and by line 131 to the closed contact of microswitch 100 and negative pin of the 12-volt relay. The reset switch 130 has normally closed contacts which open upon operation of the microswitch 100. In order to reset the system, the open contacts are closed by pressing a button on the reset switch.

After a fire has occurred, it is necessary to recharge or replace the fire extinguisher 30. To facilitate restringing of the cable assembly 35, it is preferable to use reusable links 48, 56, 60, and 69, rather than fused links. In preferred embodiments, the reusable links are calibrated to release at 160° F. for electric stoves and 370° F. for gas stoves; however, the reusable and fusible links may be configured to release at other selected temperatures within that range.

The number of links required is determined by the number of cooking surface elements on the range top. Normally, four links are required and provided with each Guardian unit. However, a maximum of two additional links may be added to the system, provided the minimum separation distances are maintained.

For applications where the maximum ambient temperature exceeds the rating for the 160° F. link used for electric ranges, a higher rated link should be used. A variety of temperature ratings are available, ranging from 160°-370° F., depending on the maximum ambient temperature recorded under the range hood 12.

The use of the low voltage circuit of FIG. 6 eliminates the hard wire and rigid metal conduit necessary with ordinary line current systems and removes the necessity of having to relight the pilot flame on gas supplied stoves. This is accomplished by maintaining electrical energy with power from a back-up battery for a gas solenoid valve. Back-up power 112 is available from 1-6 hours.

The circuit of FIG. 2 was fabricated utilizing the following circuit components:

101. Gas solenoid valve or electrical contactor (12 Volt DC).
- Supplier: ASCO (gas valve, pipe sizes $\frac{1}{4}''$-$\frac{1}{2}''$-$\frac{3}{4}''$)
- Supplier: POTTER AND BRUMFIELD (electrical contactor, rating 40A FL/50A Res. and 50A FL/60A, Res.)

127. Strobe Light (12 Volt DC).
- Supplier: Tandy Corporation (Radio Shack) or Amseco, Inc.

126. Horn (4-24 Volt DC), 85 db @10' or 90 db @10' or 100 db @10', dual tone-pulsed or steady.
- Supplier: Tandy Corporation (Radio Shack) or Moose Corporation.

128. Horn Silence Switch, general purpose 125 V AC/DC 3A one or two pole Toggle Switch with On/Off name plate.
Supplier: Tandy Corporation (Radio Shack) or EATON Cutler-Hammer or other listed switch.

115. Relay, double pole/double throw, Rated 3A @125VAC, 12 V Coil and relay socket with retaining clip mounted on circuit board.
Supplier: Tandy Corporation (Radio Shack) or Alarm Controls Corporation or Twenty First Century Int'l Fire & Svcs Corporation or SPC Technology or Potter and Brumfield.

77. Miniature Snap-Action (Micro Switch), Rated 10 A @ 125/250 VAC, 1/4 Hp, with phenolic case and coil spring mechanism.
Supplier: Cherry Electric Product Corporation or Unimax Switch Corporation.

107. Transformer, Class II type plug-in with 120 Volt 60 Hz AC primary, 12 Volt,20 VA or 18 Volt,20 VA or 18 Volt,35 VA with machine screw for securing to 120 VAC standard wall receptacle.
Supplier: Moose or other UL Listed having equal specifications.

130. Miniature Push Button Switch, momentary SPST Contacts (Normally Closed) rated 0.5 A @125 VAC.
Supplier: Tandy Corporation (Radio Shack) or other having equal specifications.

111. Light-Emitting Diode (LED), green, power dissipation 75 mW, forward current 25 mA, luminous 119. Intensity 6.3 mcd, also, 1K 1/2 W resister added to Cathode (−minus) lead.
Supplier: Tandy Corporation (Radio Shack) or other having equal specifications.

110. Power Supply and Battery Charger, regulated DC output selectable for 6.9 or 13.8 volts, 4 A self-restoring circuit breaker, 1A continuous output wit 0.2 volt ripple. Where less output is required, other power supply and battery charger to be used shall have 3 A fused circuit 13.8 VDC at 600 milliamps continuous output.
Supplier: Moose or other having equal specifications.

112. Battery, 1.2 AH, 12 volt or 4 AH, 12 volt, sealed lead acid rechargeable.
Supplier: Yuasa, Moose, PowerSonic, or other having equal specifications.

Figure 7:
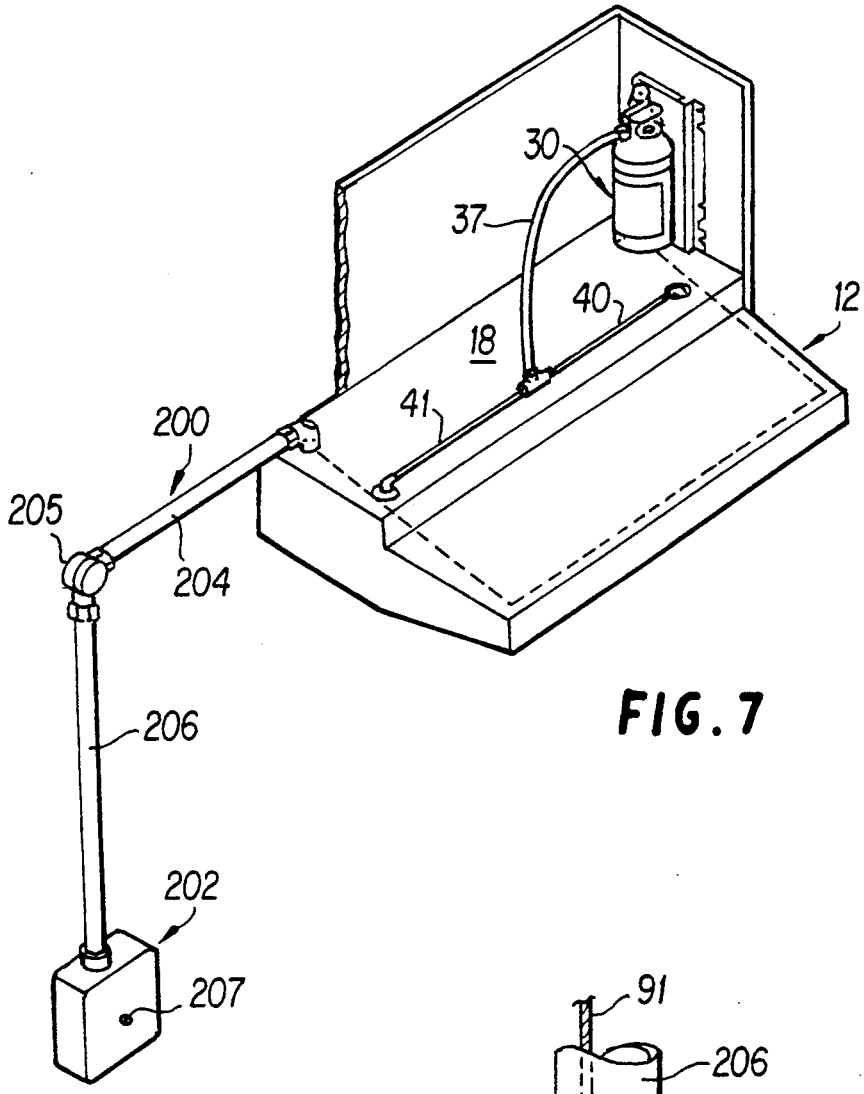
FIG. 7 is a perspective view of a remote release manual pull system according to the instant invention, optionally installable with the aforedescribed system.
Figure 8:
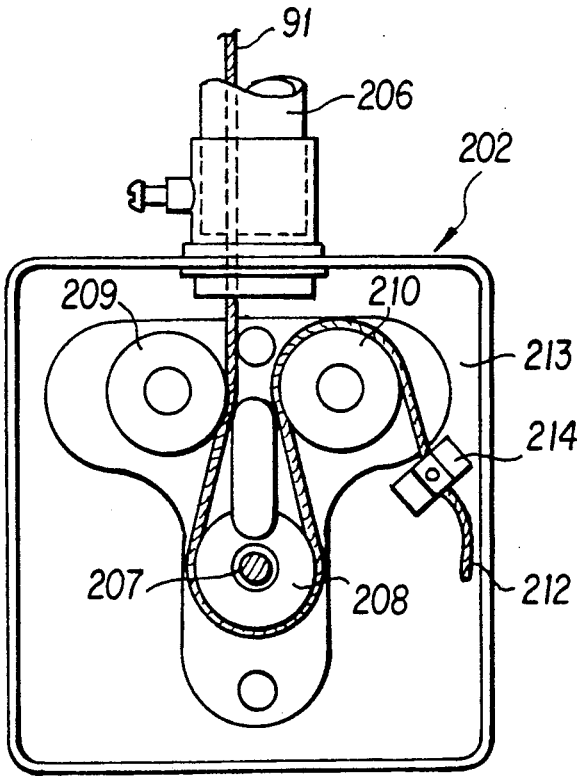
FIG. 8 is a front view of a floating pulley arrangement providing the remote release.

Referring now to FIGS. 7 and 8, there is shown a manual release system, designated generally by the numeral 200, in which the cable 91 of FIG. 1 is attached to a remote manual release assembly, designated generally, by the numeral 202, instead of being anchored by the stop 94, as in FIG. 1. The cable 91 passes around a corner pulley 203, through a ½" conduit 204, around a corner pulley 205, and through a ½" conduit 206 into the manual release assembly 202. Preferably, the length of the cable 91 is no greater than 10'. The manual release assembly 202 retains the cable 91 taut with a pull pin 207. If, for some reason, the cable assembly 35 does not release when a fire occurs, a person near the range 10 can extinguish the fire by pulling pin 207.

As is seen in FIG. 8, the cable 91 is tensioned by a floating pulley 208, which is held displaced from stationary pulleys 209 and 210 by the pin 207, which is received through the center of the floating pulley. The free end 212 of the cable 91 is anchored to the housing 213 of the manual release assembly by a cable nut 214. When the pin 207 is pulled, the floating pulley 208 is released, and the cable slackens, allowing spring 33 (FIG. 2) to pivot the operating lever 33 and thus activate the fire extinguisher 30. By having a remote manual release 202 displaced from the range 10, a manual redundancy is provided, enhancing the effectiveness of the system.

The preceding examples can be repeated with similar success by substituting the generically or specifically described components for those used in the preceding examples.

The entire disclosures of all applications, patents, and publications, cited herein, are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In combination with a kitchen cabinet, hood, and range installed in a residence, a system for extinguishing fires occurring on burners of the range, the combination comprising:

a hood having a top wall, first and second sidewalls, a front wall and a rear wall, the walls joining at first and second front corners and first and second rear corners;

a cabinet installed above the hood, the cabinet having a base in juxtaposition with the top wall of the hood;

nozzles positioned to extend out of the cabinet and within the hood, the nozzles facing the stove;

a fire extinguisher installed in the cabinet;

means for connecting the fire extinguisher to the nozzles, the connecting means including a first flexible hose extending from the fire extinguisher to a tee joint located within the cabinet and a pair of second flexible hoses extending in the cabinet from the tee joint through openings in the base of the cabinet and connecting with the nozzles;

means for operating the fire extinguisher and means for biasing the operating means to a first position which causes the fire extinguisher to discharge the fire suppressant;

means for holding the operating means in a second position against the bias of the biasing means wherein, when the operating means is in the second position, the fire extinguisher is prevented from discharging;

the means for holding the operating means in the second position including a cable means segmented in a plurality of stranded cable sections and a chain section, each section being connected to adjacent sections by reusable temperature-responsive links, the reusable temperature-responsive links being connected to the chain section by hooks insertable into selected chain links proximate opposite ends of the chain section;

cable support means positioned inside of the hood for training the cable means around the inside of the hood, the cable support means including a first cable support proximate the rear wall and adjacent to the first rear corner thereof, a second cable support proximate the front wall and adjacent the first front corner thereof, a third cable support proximate the front wall and adjacent the second front corner thereof and a fourth cable support proximate the rear wall and adjacent the second rear corner thereof; wherein the chain section of the cable means is connected between two of the stranded cable sections at a location between a pair of the cable supports with the cable sections engaging the cable supports and with the chain section positioned in spaced relation to the cable supports; whereby when at least one of the temperature-responsive links releases, only the stranded cable sections move over the supports; and means for anchoring the cable means proximate the rear wall and adjacent the second rear corner of the hood, wherein the cable means is held in tension around the inner periphery of the hood to hold the operating means in the second position whereby when there is a fire on the stove top at least one of the temperature-responsive links separates, releasing tension on the cable means and allowing the operator to move from the second position to the first position under the bias of the biasing means.

2. The combination of claim 1, wherein the supports are pulleys.

3. The combination of claim 1, wherein the temperature-responsive links are reusable temperature-responsive links.

4. In combination with a kitchen cabinet, hood and range installed in a residence, a system for extinguishing fires occurring on burners of the range, the combination comprising:

a hood having a top wall, first and second sidewalls, a front wall and a rear wall, the walls joining at first and second front corners and first and second rear corners;

a cabinet installed above the hood, the cabinet having a base in juxtaposition with the top wall of the hood;

nozzles positioned to extend out of the cabinet and within the hood, the nozzles facing the stove;

a fire extinguisher installed in the cabinet;

means for connecting the fire extinguisher to the nozzles, the connecting means including a flexible hose extending from the fire extinguisher to a tee joint located within the cabinet and a pair of pipes extending in the cabinet from the tee joint, both of the pipes comprising a straight section connected to the tee joint and an L-shaped section having one end telescopically receivable in the straight section and the other end received through an opening through the base of the cabinet and top wall of the hood and being connected to the nozzle within the hood;

means for operating the fire extinguisher and means for biasing the operating means to a first position which causes the fire extinguisher to discharge the fire suppressant;

means for holding the operating means in a second position against the bias of the biasing means wherein, when the operating means is in the second position, the fire extinguisher is prevented from discharging;

the means for holding the operating means in the second position including a cable means segmented in a plurality of sections and a chain section, each section being connected to adjacent sections by temperature-responsive links, the temperature-responsive links being connected to the chain section by hooks insertable into selected links proximate opposite ends of the chain section;

cable support means positioned inside of the hood for training the cable means around the inside of the hood, the cable support means including a first cable support proximate the rear wall and adjacent to the first rear corner thereof, a second cable support proximate the front wall and adjacent the first front corner thereof, a third cable support proximate the front wall and adjacent the second front corner thereof and a fourth cable support proximate the rear wall and adjacent the second rear corner thereof; wherein the chain section of the cable means is connected between two of the stranded cable sections at a location between a pair of the cable supports with the stranded cable sections engaging the cable supports and with the chain positioned in spaced relation to the cable supports whereby when at least one of the temperature-responsive links releases, only the stranded cable sections move over the supports; and means for anchoring the cable means proximate the rear wall and adjacent the second rear corner of the hood, wherein the cable means is held in tension around the inner periphery of the hood to hold the operating means in the second position whereby when there is a fire on the stove top at least one of the temperature-responsive links separates, releasing tension on the cable and allowing the operator to move from the second position to the first position under the bias of the biasing means.

5. The combination of claim 4, wherein the supports are pulleys.

6. The combination of claim 4, wherein the temperature-responsive links are reusable temperature-responsive links.

7. The combination of claim 4, further including remote release means for manually releasing the cable means from holding the operating means, the remote release means being displaced from the range.

8. The combination of claim 7, wherein the remote release means is attached to the cable means to hold the cable means taut until the remote release means releases the cable.

* * * * *